US005893991A

United States Patent [19]

Newell

[11] Patent Number: 5,893,991

[45] Date of Patent: Apr. 13, 1999

[54] BATTERY OPERATED HEATING SYSTEM FOR A VEST OR A JACKET

[76] Inventor: Bertha L. Newell, 602 Bonnie Brae Dr., Coraopolis, Pa. 15108

[21] Appl. No.: 08/719,245

[22] Filed: Sep. 24, 1996

[51] Int. Cl.[6] ..... H05B 1/00; H05B 3/06

[52] U.S. Cl. ..... 219/211; 219/527

[58] Field of Search ..... 219/211, 527–529, 219/549; 607/98–103, 115

[56] References Cited

U.S. PATENT DOCUMENTS

| | | | |
|---|---|---|---|
| 2,579,383 | 12/1951 | Goudsmit | 219/211 |
| 3,084,241 | 4/1963 | Carrona | 219/529 |
| 3,407,818 | 10/1968 | Costanzo | 219/529 |
| 3,501,616 | 3/1970 | Arron | 219/529 |
| 3,999,037 | 12/1976 | Metcalf Sr. | 219/211 |
| 4,061,897 | 12/1977 | Thykeson | 219/211 |
| 4,279,255 | 7/1981 | Hoffman | 219/211 |
| 4,979,502 | 12/1990 | Hunt | 601/15 |
| 5,032,705 | 7/1991 | Batcheller et al. | 219/529 |
| 5,148,002 | 9/1992 | Kuo et al. | 219/211 |

*Primary Examiner*—Mark H. Paschall
*Assistant Examiner*—Sam Paik

[57] ABSTRACT

A new Battery Operated Heating System for a Vest or a Jacket for warming the user in cold weather or for therapeutic reasons. The inventive device includes a garment vest having a right side and a left side and longitudinal heating elements. In use, after the garment vest 11 is made to include all of the elements comprising the present invention, the garment vest 11 is worn and the batteries are installed and electrically connected to the right power outlet and return 13 and the left power outlet and return 15. The garment vest 11 is equipped with a plurality of separate control settings where the right side 12 is controlled separate from the left side 14 and the right side 12 can be set at one setting while the left side 14 is at another setting.

1 Claim, 3 Drawing Sheets

Fig. 1
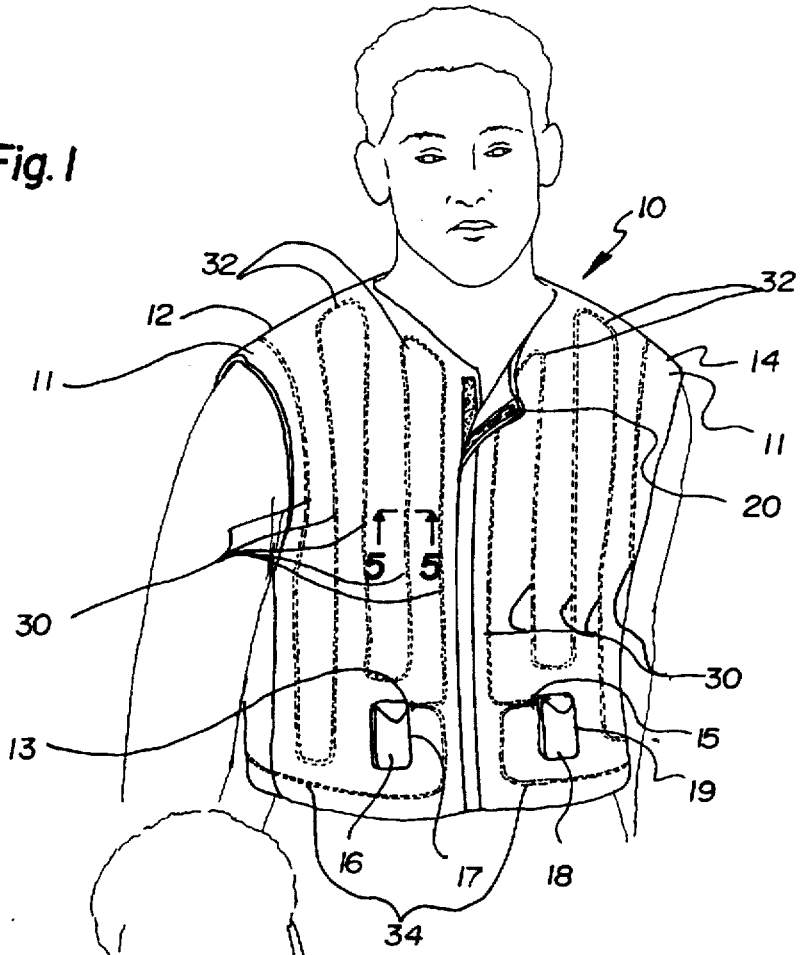
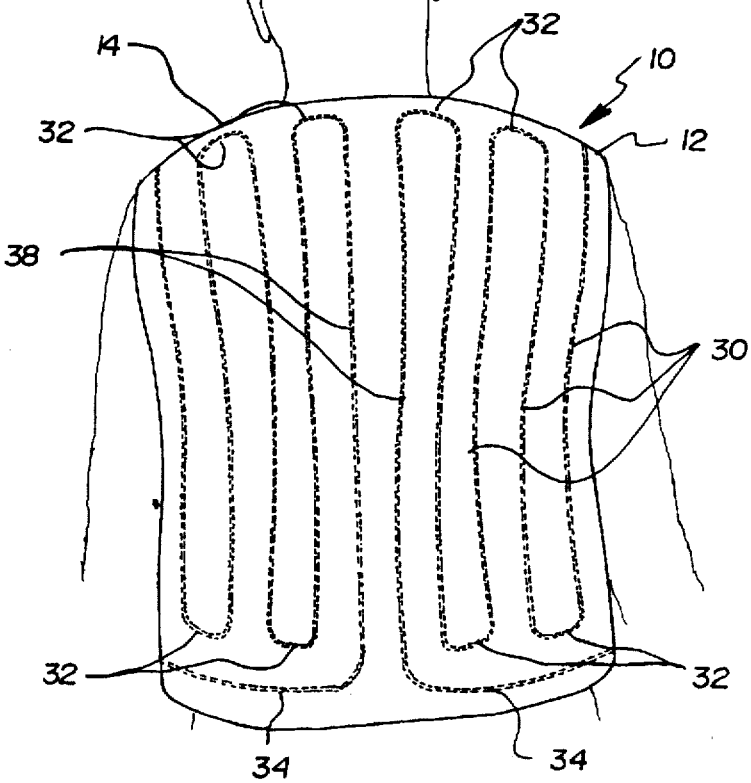
Fig. 2

Fig. 5
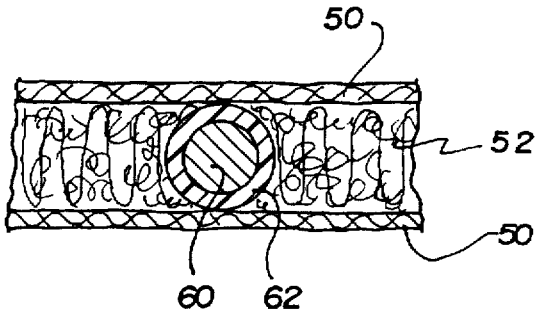
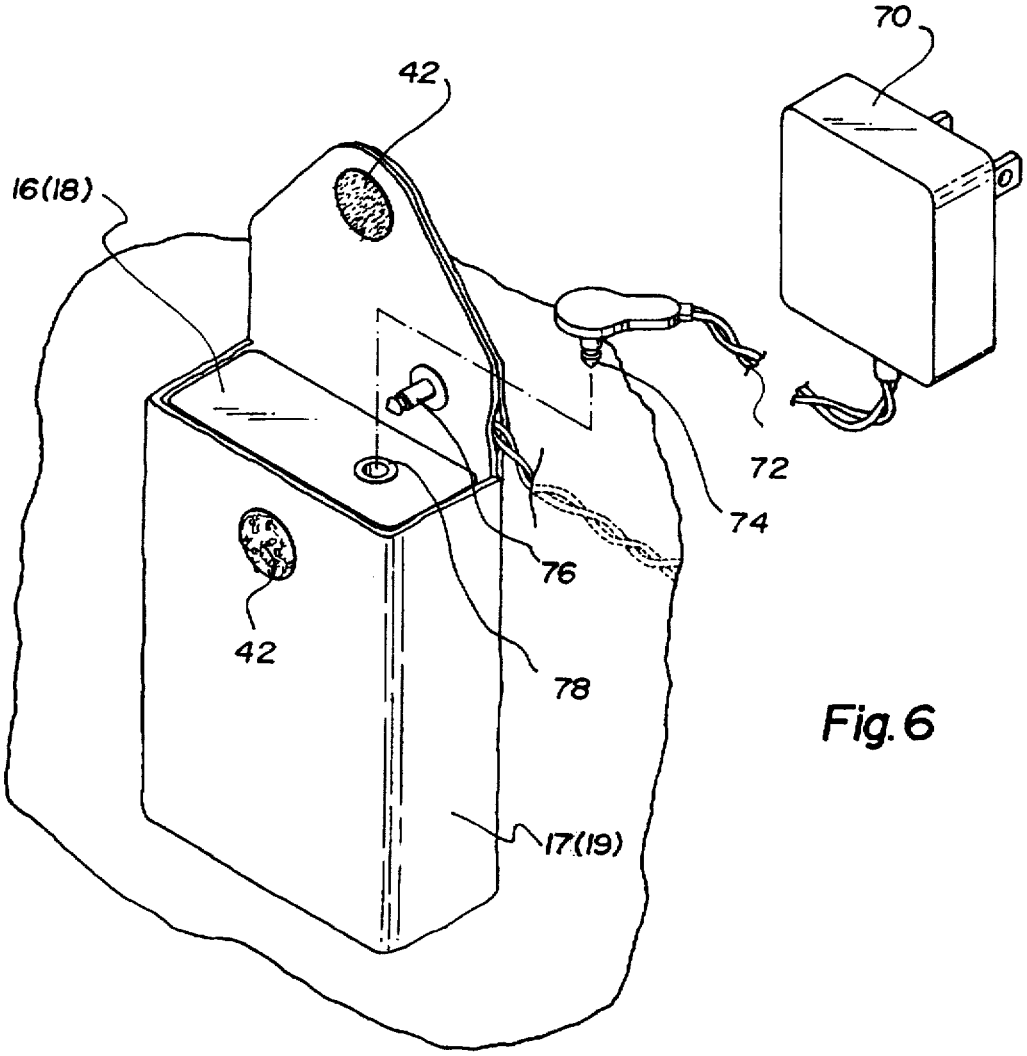
Fig. 6

BATTERY OPERATED HEATING SYSTEM FOR A VEST OR A JACKET

BACKGROUND OF THE INVENTION

1. Field of the Invention

The present invention relates to cold weather clothing and more particularly pertains to a new Battery Operated Heating System for a Vest or a Jacket for warming the user in cold weather or for therapeutic reasons.

2. Description of the Prior Art

The use of cold weather clothing is known in the prior art. More specifically, cold weather clothing heretofore devised and utilized are known to consist basically of familiar, expected and obvious structural configurations, notwithstanding the myriad of designs encompassed by the crowded prior art which have been developed for the fulfillment of countless objectives and requirements.

Known prior art cold weather clothing include U.S. Pat. No. 3,501,616; U.S. Pat. No. 5,302,806; U.S. Pat. No. Des. 332,514; U.S. Pat. No. 4,061,897; U.S. Pat. No. 5,160,828, and U.S. Pat. No. 4,679,561.

While these devices fulfill their respective, particular objectives and requirements, the aforementioned patents do not disclose a new Battery Operated Heating System for a Vest or a Jacket. The inventive device includes a garment vest having a right side and a left side and longitudinal heating elements.

In these respects, the Battery Operated Heating System for a Vest or a Jacket according to the present invention substantially departs from the conventional concepts and designs of the prior art, and in so doing provides an apparatus primarily developed for the purpose of warming the user in cold weather or for therapeutic reasons.

SUMMARY OF THE INVENTION

In view of the foregoing disadvantages inherent in the known types of cold weather clothing now present in the prior art, the present invention provides a new Battery Operated Heating System for a Vest or a Jacket construction wherein the same can be utilized for warming the user in cold weather or for therapeutic reasons.

The general purpose of the present invention, which will be described subsequently in greater detail, is to provide a new Battery Operated Heating System for a Vest or a Jacket apparatus and method which has many of the advantages of the cold weather clothing mentioned heretofore and many novel features that result in a new Battery Operated Heating System for a Vest or a Jacket which is not anticipated, rendered obvious, suggested, or even implied by any of the prior art cold weather clothing, either alone or in any combination thereof.

To attain this, the present invention generally comprises a garment vest having a right side and a left side and longitudinal heating elements.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Battery Operated Heating System for a Vest or a Jacket apparatus and method which has many of the advantages of the cold weather clothing mentioned heretofore and many novel features that result in a new Battery Operated Heating System for a Vest or a Jacket which is not anticipated, rendered obvious, suggested, or even implied by any of the prior art cold weather clothing, either alone or in any combination thereof.

It is another object of the present invention to provide a new Battery Operated Heating System for a Vest or a Jacket which may be easily and efficiently manufactured and marketed.

It is a further object of the present invention to provide a new Battery Operated Heating System for a Vest or a Jacket which is of a durable and reliable construction An even further object of the present invention is to provide a new Battery Operated Heating System for a Vest or a Jacket which is susceptible of a low cost of manufacture with regard to both materials and labor, and which accordingly is then susceptible of low prices of sale to the consuming public, thereby making such Battery Operated Heating System for a Vest or a Jacket economically available to the buying public.

Still yet another object of the present invention is to provide a new Battery Operated Heating System for a Vest or a Jacket which provides in the apparatuses and methods of the prior art some of the advantages thereof, while simultaneously overcoming some of the disadvantages normally associated therewith.

Still another object of the present invention is to provide a new Battery Operated Heating System for a Vest or a Jacket for warming the user in cold weather or for therapeutic reasons.

Yet another object of the present invention is to provide a new Battery Operated Heating System for a Vest or a Jacket which includes a garment vest having a right side and a left side and longitudinal heating elements.

Still yet another object of the present invention is to provide a new Battery Operated Heating System for a Vest or a Jacket that provides a more cost effective device.

Even still another object of the present invention is to provide a new Battery Operated Heating System for a Vest or a Jacket that can warm one side of the user at a different heat rate than the other side.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front perspective view of a new Battery Operated Heating System for a Vest or a Jacket according to the present invention.

FIG. 2 is a rear perspective view of a new Battery Operated Heating System for a Vest or a Jacket according to the present invention.

FIG. 5 is a cross sectional view taken along line 5—5 of FIG. 1.

FIG. 6 is an enlarged detail view of an alternate embodiment of the power supply of the invention.

DESCRIPTION OF THE PREFERRED EMBODIMENT

Figure 3:
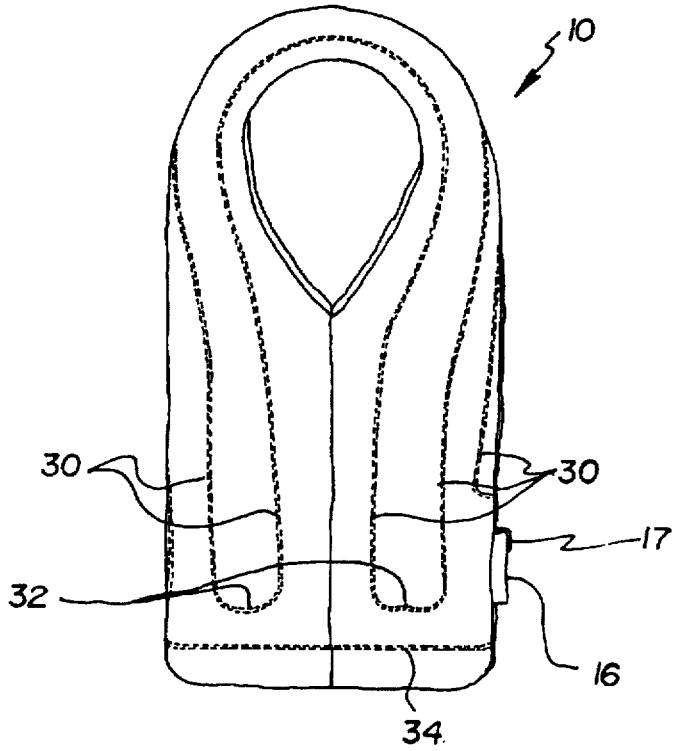
FIG. 3 is side elevation view of the present invention.
Figure 4:
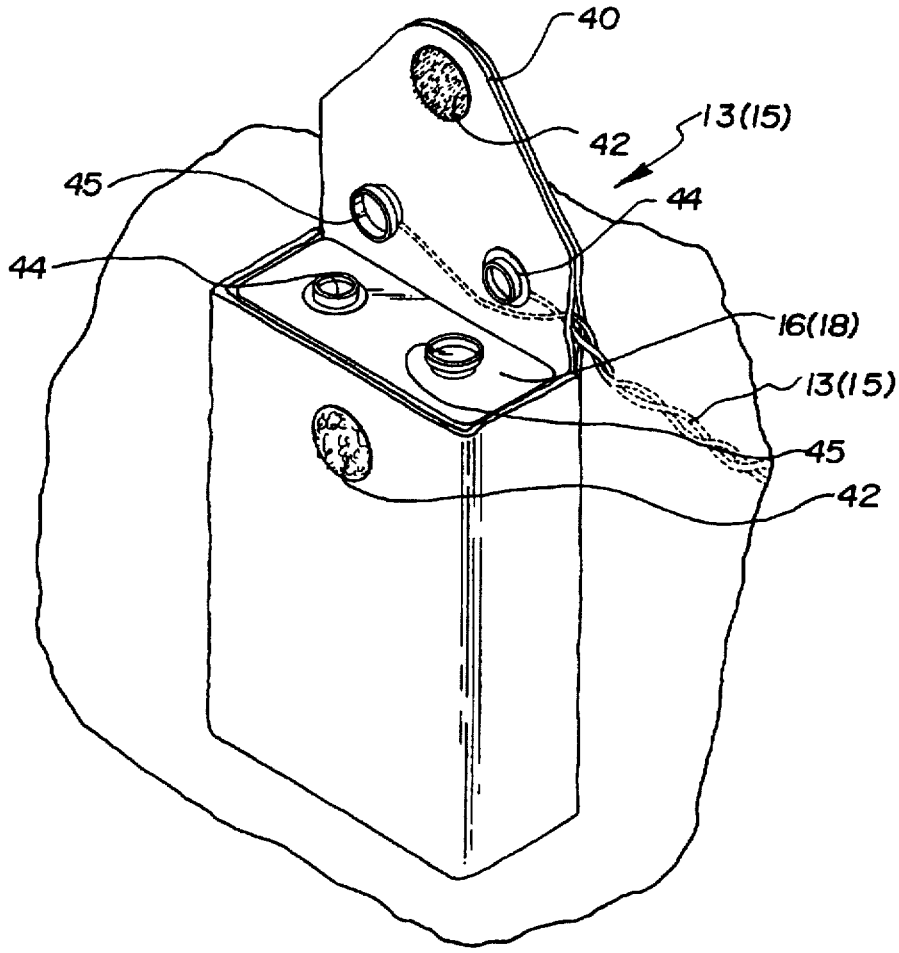
FIG. 4 is an enlarged detail view of a power supply of the invention.

With reference now to the drawings, and in particular to FIGS. 1 through 6 thereof, a new Battery Operated Heating System for a Vest or a Jacket embodying the principles and concepts of the present invention and generally designated by the reference numeral 10 will be described.

More specifically, it will be noted that the Battery Operated Heating System for a Vest or a Jacket 10 comprises a garment vest 11 having a right side 12 and a left side 14 and longitudinal heating elements 30.

As best illustrated in FIGS. 1 through 6, it can be shown that the garment vest 11 is further comprised of the right side 12 and the left side 14 where each have longitudinal heating elements 30. Furthermore, the longitudinal heating elements 30 are electrically connected at their ends by latitudinal end heating elements 32. The right side 12 and the left side 14 further include at least one distal longitudinal heating element 38 that is electrically connected to a circumferential return heating element 34.

The right side 12 and the left side 14 further include a right power supply 16 and a left power supply 18, where the right power supply 16 includes a right power outlet and return 13 and the left power supply 18 includes a left power outlet and return 15. The right power supply 16 is retainably held within a right power pocket 17 and the left power supply 18 is retainably held within a left power pocket 19.

The garment vest 11 is held closed around the person's torso by an attachment means 20. The attachment means 20 is further defined to be Velcro or other equivalent material.

The right power pocket 17 and the left power pocket 19 further include a pouch flap 40 where the pouch flap 40 also includes a pouch attachment means 42 which can be further defined as Velcro or other equivalent material.

The right power supply 16 and the left power supply 18 are each equipped with a male plug fitting 44 and a female receptacle 45. Likewise, the pouch flap 40 of each the right power pocket 17 and the left power pocket 19 also includes the male plug fitting 44 and the female receptacle 45 in opposite mating manner so that they can be electrically mated to the male plug fitting 44 and the female receptacle 45 of the right power supply 16 and the left power supply 18.

Referring to FIG. 5, the garment vest 11 is also comprised of a fabric covering 50 which provides the surface to the outside and the inside of the garment vest 11. The fabric covering 50 is separated by an insulated lining 52 which has a wire 60 enclosed within a wire insulation 62 substantially lying along a median and where the wire 60 further defines the basic structure of the heating elements.

Referring to FIG. 6, the right power supply 16 and the left power supply 18 can have an alternate embodiment that is rechargeable by virtue of an AC voltage adapter 70. The AC voltage adapter 70 is electrically connected to a recharge cord 72 which terminates in a coaxial recharge connector 74 which is matingly received by a coaxial power outlet aperture 76 which can be included in the pouch flat 40. The coaxial power outlet aperture 76 further defines a coaxial connector that is electrically connected to the right power outlet and return 13 and the left power outlet and return 15. The right power supply 16 and the left power supply 18, in this embodiment, would include a coaxial battery outlet aperture 78 which would matingly receive the coaxial power outlet aperture 76.

In use, after the garment vest 11 is made to include all of the elements comprising the present invention, the garment vest 11 is worn and the batteries are installed and electrically connected to the right power outlet and return 13 and the left power outlet and return 15. The garment vest 11 is equipped with a plurality of separate control settings where the right side 12 is controlled separate from the left side 14 and the right side 12 can be set at one setting while the left side 14 is at another setting.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A battery operated heating system for a vest or a jacket comprising:

a garment vest having a right side and a left side and longitudinal heating elements;

wherein the garment vest is further comprised of the right side and the left side where each have respective longitudinal heating elements and where the longitudinal heating elements are electrically connected at their ends by latitudinal end heating elements and where the right side and the left side further include at least one distal longitudinal heating element that is electrically connected to a circumferential return heating element, wherein at least one of the longitudinal heating elements of each side of the garment extends over a top surface of a shoulder portion of the corresponding side of the garment;

wherein the right side and the left side further include a right power supply and a left power supply, where the right power supply includes a right power outlet and return and the left power supply includes a left power outlet and return and where the right power supply is retainably held within a right power pocket, said right power pocket being integral with the right side of the garment vest, and the left power supply is retainably held within a left power pocket, said left power pocket being integral to the left side of the garment vest;

wherein the garment vest is held closed around the person's torso by an attachment means;

wherein the right power pocket and the left power pocket further include a pouch flap where the pouch flap also includes a pouch attachment means;

wherein the right power supply and the left power supply are each equipped with a male plug fitting and a female receptacle and where the pouch flap of each the right power pocket and the left power pocket also includes the male plug fitting and the female receptacle in opposite mating manner so that they can be electrically mated to the male plug fitting and the female receptacle of the right power supply and the left power supply;

wherein said male plug and said female receptacle are connected to said heating elements such that said right and left power outlets and returns extend laterally from the corresponding pouch flap exterior of the pouch and the garment for entry within an opening formed in the garment such that the power outlets and returns reside along a pivoting axis of the corresponding pouch flap;

wherein the garment vest is also comprised of a fabric covering which provides the surface to the outside and the inside of the garment vest and where the fabric covering is separated by an insulated lining which has a wire enclosed within a wire insulation substantially lying along a median and where the wire further defines the basic structure of the heating elements;

wherein the garment vest is equipped with a plurality of separate control settings where the right side is controlled separate from the left side and the right side can be set at one setting while the left side is at another setting.

* * * * *